United States Patent [19]

Bolin

[11] Patent Number: 4,662,447

[45] Date of Patent: May 5, 1987

[54] GRAVEL PACKING METHOD AND APPARATUS

[75] Inventor: Michael L. Bolin, Knoxville, Tenn.

[73] Assignee: Halliburton Company, Duncan, Okla.

[21] Appl. No.: 848,424

[22] Filed: Apr. 4, 1986

[51] Int. Cl.[4] ..... E21B 43/04

[52] U.S. Cl. ..... 166/278; 166/51

[58] Field of Search ..... 166/278, 276, 51, 326; 252/855 R

[56] References Cited

U.S. PATENT DOCUMENTS

| | | | |
|---|---|---|---|
| 3,064,730 | 11/1962 | Malone et al. | 166/15 |
| 3,199,590 | 8/1965 | Young | 166/33 |
| 3,415,320 | 12/1968 | Young | 166/33 |
| 4,016,931 | 4/1977 | Cryar, Jr. | 166/276 |
| 4,042,032 | 8/1977 | Anderson et al. | 166/276 |
| 4,044,832 | 8/1977 | Richard et al. | 166/278 |
| 4,105,069 | 8/1978 | Baker | 166/51 |
| 4,220,566 | 9/1980 | Constien et al. | 166/276 X |
| 4,259,205 | 3/1981 | Murphey | 252/326 |
| 4,270,608 | 6/1981 | Hendrickson et al. | 166/278 |
| 4,273,190 | 6/1981 | Baker et al. | 166/278 |
| 4,295,524 | 10/1981 | Baker et al. | 166/278 |
| 4,361,187 | 11/1982 | Luers | 166/326 |
| 4,384,615 | 5/1983 | Luers | 166/326 |
| 4,418,754 | 12/1983 | Stepp | 166/278 |
| 4,428,427 | 1/1984 | Friedman | 166/278 |
| 4,560,486 | 12/1985 | Hinkel | 166/308 X |
| 4,570,714 | 2/1986 | Turner et al. | 166/278 |

OTHER PUBLICATIONS

Halliburton Services catalog No. 41, pp. 3965–3968.

*Primary Examiner*—Stephen J. Novosad
*Assistant Examiner*—David J. Bagnell
*Attorney, Agent, or Firm*—Joseph A. Walkowski; Neal R. Kennedy

[57] ABSTRACT

A method of gravel packing a well formation and an apparatus usable therefor. The method of gravel packing includes mixing a slurry formed by solids suspended in a gelled carrier fluid with a breaker fluid at a subterranean position above the well formation to be packed, whereby the gel is broken into a low viscosity fluid which is pumped along with the solids to the formation for packing thereof. The apparatus includes a mixing valve positioned in a tool string above a packer, crossover tool and liner screen. When the tool string is run into the well, the mixing valve defines said subterranean position. The breaker fluid is spotted in an annulus between the tool string and well bore, above the packer. The gelled slurry is pumped down the tool string to the mixing valve, and the breaker fluid is introduced through the mixing valve into the tool string for mixing with the gel. The resultant low viscosity fluid and solids are pumped through the crossover tool into the annulus between the liner screen and well formation for packing.

14 Claims, 1 Drawing Figure

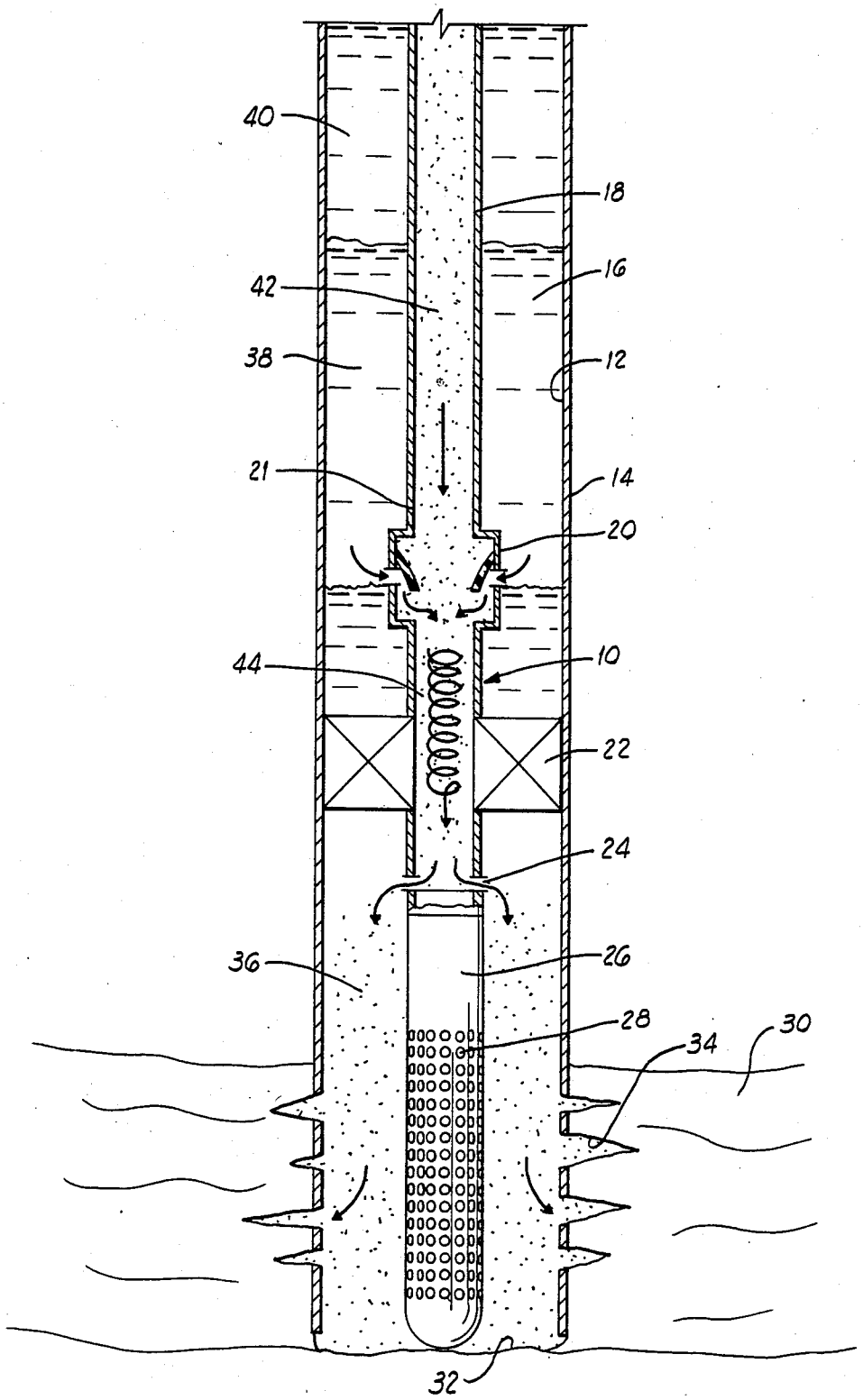
40
18
42
16
38
12
21
14
20
44
10
22
24
36
26
28
34
30
32

GRAVEL PACKING METHOD AND APPARATUS

BACKGROUND OF THE INVENTION

1. Field of the Invention

This invention relates to methods and apparatus for gravel packing well formations, and more particularly to a gravel packing method and apparatus wherein downhole mixing of a gel slurry with a breaker fluid is utilized.

2. Description of the Prior Art

Unconsolidated formations, particularly those containing loose sands and soft sandstone strata, present constant problems in well production due to migration of loose sands and degraded sandstone into the well bore as the formation deteriorates under the pressure and flow of fluids therethrough. This migration of particles may eventually clog the flow passages in the production system of the well, and can seriously erode the equipment. In some instances, the clogging of the production system may lead to a complete cessation of flow, or "killing" of the well.

One leading method of controlling sand migration into a well bore consists of placing a pack of gravel on the exterior of a liner assembly having a perforated or slotted liner or screen which is positioned across an unconsolidated formation, commonly referred to as the "zone" to be packed. The gravel pack presents a barrier to the migrating sand from that formation while still permitting fluid flow. The gravel is carried to the formation in the form of a slurry. The proper size of gravel must be employed to effectively halt sand migration through the pack, the apertures of the liner or screen being adapted so that the gravel will not pass through it.

The gravel is a solid, particulate material, such as very fine sand.

Once the liner or screen is positioned across the zone, a packer is set above the zone between the liner and the well casing, or, if unlined, the well bore wall, to isolate that zone from those above. The zone may be at any point in the well.

The solid material used in the gravel packing is pumped down the tool string in a gravel slurry formed by mixing the solids in a carrier fluid. The slurry passes through a crossover tool and out into the annulus between the liner and the casing at a suitable location above the zone, and the gravel is deposited in the area around the screen.

Typical apparatus and methods for gravel packing are disclosed in U.S. Pat. Nos. 4,270,608; 4,273,190; 4,295,524; 4,296,807; and 4,418,754.

For the purposes of distributing the gravel into the formation, a low viscosity gravel slurry, such as an aqueous solution, is preferable, because the low viscosity fluid will flow well into the formation, and thus carry the gravel further into the formation for better packing. This reduces the possibilities of washing out the gravel when production fluids are flowed therethrough.

However, a low viscosity carrier fluid is frequently not adequate for several reasons. First of all, a low viscosity fluid cannot suspend or hold as much gravel therein as a higher viscosity fluid. Further, with low viscosity fluids, the gravel tends to settle out into the tubing string before it reaches the well annulus adjacent the formation. To solve this "sand-out" problem, higher viscosity gel slurries have been developed. Generally, the carrier fluid in such a slurry is formed by mixing an aqueous or petroleum base solution with a gelling agent.

Such gelled slurries perform well in carrying the sand down the tubing string into the well annulus, but because of the high viscosity of the carrier fluid, the sand is not distributed as well into the formation. This results in poorer pack density and increased chances of premature erosion of the formation. Further, high viscosity fluids are more likely to result in formation damage.

An additional problem with gelled slurries is that it takes longer for the sand to settle out once it is in the annulus. This increases the waiting time at the surface and therefore costs are higher.

Thus, it has been recognized in the sand control field that the ideal gravel pack method would be to use a gel as a carrier fluid down to the top of the screen, then use a low viscosity carrier fluid, such as an aqueous solution, throughout the rest of the gravel packing job. This method would present the best advantages of both a gelled carrier fluid and a low viscosity carrier fluid. As a result, methods have been developed to break the gel down when it reaches the desired location above the liner screen. Such methods include employing a gel based carrier which will automatically break down after a certain period of time. Such a method is described in U.S. Pat. No. 4,259,205. A problem with such methods is that once the slurry has been mixed, the operation must be carried out within the predetermined time. If there are any delays in the gravel packing operation, the gel slurry will break down prematurely, such as when it is being pumped down the tubing string. This has the undesirable result of the sand settling out prematurely or "sanding-out", as is the case with aqueous carrier fluids.

The method of the present invention solves the problems with previous gravel packing operations in that a gel slurry is used to carry the sand down the hole and is mixed at a predetermined location above the screen with a breaker fluid in place in the well annulus. A mixing valve positioned above the packer is utilized for this purpose.

A mixing valve for use in cementing, fracturing and other treatment of wells, is shown in U.S. Pat. No. 4,361,187, assigned to the assignee of the present application and incorporated herein by reference.

SUMMARY OF THE INVENTION

The method of gravel packing a well formation of the present invention comprises forming a gel for transporting solids, forming a slurry by mixing the solids with the gel, transporting the gel and solids mixed therein to a subterranean position above the well formation to be packed, mixing a breaker fluid with the gel and solids at said subterranean position whereby the gel is broken into a low viscosity fluid, and further transporting the resultant low viscosity fluid and solids to the formation for packing of the formation.

An apparatus usable in the gravel packing method comprises an upper tool string portion, mixing means on the tool string portion adapted to allow mixing of the breaker fluid with the gel, the breaker fluid being previously spotted in the annulus between the tool string and the well bore, with the gel slurry in the tool string, packer means positioned below the mixing means, crossover means positioned beneath the packer, and a liner screen attached to the tool string below the crossover means and positionable adjacent the well formation. after the tool string is made up, it is run into the well bore such that the screen is adjacent the subterranean zone or formation to be packed.

It is, therefore, an important object of the present invention to provide a method of gravel packing a well formation in which a gelled slurry is mixed with a breaker fluid at a subterranean position above the formation to be packed.

Another object of the invention is to provide a method of gravel packing in which a gel based slurry is used to carry the gravel down the tubing string to a point above the liner screen and in which a low viscosity carrier fluid is utilized to carry out the actual gravel packing process by carrying the gravel into the formation.

A further object of the invention is to provide a gravel packing apparatus having mixing means adapted for mixing a breaker fluid and a gel based slurry at a point above the well formation to be packed.

Additional objects and advantages of the invention will become apparent as the following detailed description of the preferred embodiment is read in conjunction with the accompanying drawing which illustrates such preferred embodiment.

BRIEF DESCRIPTION OF THE DRAWING

FIG. 1 is a schematic illustrating the gravel packing method of the present invention and an apparatus for carrying out the method.

DESCRIPTION OF THE PREFERRED EMBODIMENT

Referring now to FIG. 1, a tool string 10 is positioned in a well bore 12 formed by a casing 14 such that an annulus 16 is formed between the tool string and casing.

Tool string 10 includes an upper tool string portion 18 having mixing means thereon, best characterized by a mixing valve 20 attached to a lower end 21 of the upper tool string portion. Mixing valve 20 is preferably a differential pressure responsive valve such as is described in the aforesaid U.S. Pat. No. 4,361,187, incorporated by reference.

Tool string 10 also includes packer means and crossover means adjacent the packer means, both of which are well known in the art, which are positioned below the mixing means. The packer means and crossover means are characterized by a packer 22 below mixing valve 20 and a crossover tool 24 below packer 22. Packer 22 and crossover tool 24 may be separate tools, but frequently they are integrally formed in a single tool. An example of such a combination adaptable to the present method and employing a permanent packer is disclosed in U.S. patent application Ser. No. 850,473, filed on even date herewith and incorporated herein by reference.

Positioned in tool string 10 below crossover tool 24 is a liner screen 26 having a plurality of openings 28 therein.

Tool string 10 is run into well bore 12 such that liner screen 26, and particularly openings 28 therein, are positioned adjacent a subterranean zone or formation 30 which is to be gravel packed. As illustrated in FIG. 1, casing 14 may extend to approximately the bottom 32 of the well. In such a configuration, a plurality of perforations 34 are formed to extend through casing 14 into formation 30 in a manner known in the art. However, casing 14 could also extend down only to the top of formation 30, and the unlined formation packed by the same method described herein.

In previously known gravel packing operations, mixing valve 20 would not be present. Packer 22 is set, and a gravel or sand slurry is pumped down tool string 10, through crossover tool 24 into a lower annulus 36, defined between liner screen 26 and well bore 12, and below packer 22. Pressure is applied through tool string 10 to "squeeze" the sand slurry into formation 30 through perforations 34 and into a pack about liner screen 26.

The slurries typically used are formed by mixing the solids or particulate material, such as sand, with a carrier fluid. A low viscosity carrier fluid, such as an aqueous solution, is desirable in gravel packing because the low viscosity fluid rapidly dissipates into formation 30, and thus carries the solid material further into the formation. This results in better packing and reduced likelihood of premature washing out of the sand during production.

While a variety of aqueous fluids of low viscosity, which are characterized by high loss to subterranean formations, can be utilized, aqueous salt solutions are preferred. Particularly preferred aqueous salt solutions include sodium chloride solutions, for example, 15% sodium chloride by weight; potassium and ammonium chloride solutions, for example, 2–4% potassium chloride or ammonium chloride by weight; heavy brines, for example, brines containing high concentrations of calcium chloride and calcium bromide; naturally occurring oil field brines; and bay or sea water. The viscosity of such aqueous carrier fluids is preferably in the range of from about 1 to about 3 centipoises.

However, low viscosity fluids can only carry relatively small amounts of solids suspended therein. Another problem with low viscosity slurries is that the solid material frequently settles out prematurely in the tool string, which not only does not provide proper packing, but can prevent proper operation of the tools. To solve this "sand-out" problem, high viscosity gravel slurries have been developed which carry more solid material and which prevent premature settling of the solids in the tool string.

These higher viscosity gel slurries are formed by mixing the solid material with a gelled carrier fluid. Frequently, the carrier fluid is a gelled aqueous carrier fluid formed by mixing an aqueous solution with a gelling agent, although petroleum based carrier fluids are also used.

The aqueous solution used to form the gel is generally one of a group which includes fresh water, oil field brines, bay or sea water, or other aqueous salt solutions, such as those described above.

The gelling agents used with aqueous solutions are generally hydratable polymers which contain, in sufficient concentration and reactive position, one or more functional groups such as hydroxyl, cis-hydroxyl, carboxyl, sulfate, sulfonate, amino or amide. Particularly suitable such polymers are polysaccharides and derivatives thereof which contain one or more of the monosaccharide units, galactose, manose, glucoside, glucose, xylose, arabinose, fructose, glucuronic acid or pyranosyl sulfate. Natural hydratable polymers containing the foregoing functional groups and units include guar gum and derivatives thereof, locust bean gum, tara, konjak, tamarind, starch, cellulose and derivatives thereof, karaya, xanthan, tragacanth and carrageenan. Hydratable synthetic polymers and copolymers containing the above-mentioned functional groups can also be utilized such as polyacrylate, polymethacrylate, polyacrylamide, polyvinyl alcohol, and polycinylpyrrolidone.

Such gelling agents are combined with the aqueous solution used in an amount in the range of from about 10 to about 120 pounds of gelling agent per 1,000 gallons of aqueous fluid. These gelled aqueous carrier fluids are capable of carrying relatively high concentrations of solids, for example, 10 to 15 pounds of gravel per gallon of carrier fluid.

Such high viscosity gel slurries are used successfully in transporting high concentrations of solids, such as gravel, efficiently down the well bore into an annulus adjacent the formation. However, such high viscosity carrier fluids suffer from the disadvantage that rapid dissipation of the carrier fluids into surrounding formations does not occur during the placement of the gravel. This often results in voids being formed in the gravel pack produced. In addition, such high viscosity carrier fluids can cause damage to the permeability of the formations into which they are caused to flow, in effect plugging the formations.

In the method of the present invention, the problems with both types of carrier fluids are eliminated while combining the advantages of both. The method comprises the steps of forming a gel for transporting the gravel and forming a slurry by mixing the gravel with the gel, as described above, and transporting the resulting slurry to a subterranean mixing position above formation 30. The method further comprises mixing a breaker fluid with the gelled slurry at this subterranean position, whereby the gel is broken into a low viscosity fluid, and then transporting this resultant low viscosity fluid and the gravel to the formation for packing thereof, as hereinafter described in detail.

The breaker fluids usable with the gels formed from the chemical components described above are numerous. Typically, aqueous acid solutions are used.

In the present method, after tool string 10 has been run into well bore 12, a gel based carrier fluid, such as those already described, is used to carry a high concentration of sand in a slurry 42. The step of transporting the slurry to the subterranean mixing position comprises pumping the slurry through the pumps and service equipment and down tool string 10 to mixing valve 20 which defines the subterranean mixing position. Ahead of the slurry is a pad of clean fluid, and ahead of that is a breaker fluid 38 which is spotted into annulus 16 through crossover tool 24 before the setting of packer 22, displacing the drilling fluid or "mud" located in annulus 16 above breaker fluid 38 until breaker fluid 38 is adjacent to and above mixing valve 20. Packer 20 is then set to isolate lower annulus 36 from upper annulus 16.

The step of mixing the breaker fluid with the slurry comprises applying a higher relative pressure to fluid 40 in annulus 16 than that in tool string 10 so that breaker fluid 38 is introduced into slurry 42 through the mixing valve. Mixing of gelled slurry 42 and breaker fluid 38 thus occurs in a mixing area 44 in tool string 10 approximately between mixing valve 20 and crossover tool 24.

The breaker fluid breaks down the high viscosity gelled carrier fluid to a low viscosity, substantially aqueous carrier fluid. This resultant low viscosity carrier fluid, and the solids still mixed therein, are pumped through crossover tool 24 into lower annulus 36 for packing the gravel into formation 30. Continuing pressure is applied during the packing operation to squeeze the gravel into the formation face and into a consolidated pack. After the pack is achieved, pressure may be continued on annulus 16 from the surface, while pressure is relieved at the surface on tool string 10. Thus, any unused slurry is pumped back up tool string 10 to the surface ("reversed out"), and is flushed out with the fluid in the annulus, a clean fluid being circulated down annulus 16, through mixing valve 20 and up to the surface through upper portion 18 of tool string 10.

After the pack is placed, and the tool string 10 is reversed out above mixing valve 20, the formation may be produced through screen 26. Depending upon the exact makeup of the tool string, crossover 24 could be closed and the formation produced through tool string 10 already in place. A more likely alternative, to eliminate the possibility of leakage through mixing valve 20, is to disengage tool string 10 from liner screen 26, remove tool string 10 from the well, and place a production tubing string with a packer thereon in the well, stabbing into a polished nipple at the top of the liner screen with a seal assembly at the bottom of the production string. An overshot seal assembly might also be employed. Finally, tool string 10 could be disengaged above packer 22, which would be a permanent packer, and a production tubing string stabbed into or over the top of packer 22 to produce the formation.

Thus, the gravel packing method of the present invention has the best advantages of the gel based carrier fluids for transporting the gravel down the tool string, in that large amounts of gravel are carried and premature settling or "sand-out" is prevented. Also, the heretofore enumerated best advantages of low viscosity carrying fluids are utilized to do the actual gravel packing process which results in better pack density and less possibility of formation damage. Further, because the low viscosity fluid transports the gravel more easily into the formation, lower injection pressures at the surface are required. Because of the better packing, there is a reduced likelihood of washing out of the gravel when the well is in production. Also, because the low viscosity fluid carries the gravel into lower annulus 36, the gravel settles therein more quickly, and therefore, there is a reduced waiting time for the gravel pack to settle, as opposed to when higher viscosity carrier fluids are used in this portion of the process.

As previously noted, prior art methods have utilized, with varying degrees of success, employing gelled carrier fluids having latent breakers which automatically break the gelled carrier fluid down into a lower viscosity fluid after a certain period of time and under certain temperature conditions. Such mixtures will work if the gravel is delivered to the formation at the proper time. However, if there is a miscalculation in determing time of gel breaking, or if there are delays in carrying out the packing operation, the gel will break down into a lower viscosity fluid at the wrong time and in the wrong location, e.g., the tool string. The present invention avoids this problem by allowing the operator to mix the breaker fluid with the gel at a subterranean position in order to break the gel down only when desired. Since time is not critical as with automatically breaking gels, an operator using the present method can hold the gel slurry at the surface or in the tool string in the event of a delay on the job.

Another advantage to the method of the present invention is that better clean-up is allowed on reversing out through the tool string, because the high viscosity gel has not been broken down into a lower viscosity fluid and thus carries its load of gravel back up tool string 10 to the surface more easily.

The method of the present invention could be used on virtually any gravel pack tool string in which mixing means are provided for mixing the breaker fluid with the gelled slurry at the desired location. The method is not limited to use with the particular gravel pack tool string illustrated herein.

It may be seen, therefore, that the method of gravel packing of the present invention is well adapted to carry out the objects and obtain the ends and advantages mentioned, as well as those inherent therein. While a presently preferred embodiment of the method of the invention, and of an apparatus for carrying out the method, have been described for the purposes of this disclosure, numerous changes can be made by those skilled in the art. All such changes are encompassed within the scope and spirit of this invention as defined by the appended claims.

What is claimed is:

1. A method of gravel packing a well formation intersected by a well bore, said method comprising:

forming a gel for transporting solids;

mixing said solids with said gel;

pumping said gel and solids mixed therein through a tool string disposed in said well bore to a subterranean position above said formation;

pumping a breaker fluid to said subterranean position through an annulus breaker between said tool string and the wall of said well bore;

introducing said breaker fluid into said tool string at said subterranean position and mixing said breaker fluid with said gel and solids thereat whereby said gel is broken into a low viscosity fluid; and transporting the resultant low viscosity fluid and solids mixed therein to said formation for packing thereof.

2. The method of claim 1 wherein said step of forming said gel comprises forming a gelled aqueous carrier fluid by mixing an aqueous solution with a gelling agent.

3. The method of claim 2 wherein said aqueous solution is one of a group including fresh water, oil field brines, bay water, sea water, and an aqueous salt solution.

4. The method of claim 2 wherein said gelling agent is a hydratable polymer.

5. The method of claim 4 wherein said hydratable polymer is a polysaccharide.

6. The method of claim 1 wherein said breaking fluid is an aqueous acid solution.

7. A method of gravel packing a subterranean zone in a well, said method comprising:

making up a tool string comprising:

a screen at a lower end of said tool string;

a packer and a crossover tool therebelow above said screen; and a mixing valve above said packer and crossover tool;

positioning said tool string in a well bore such that said screen is adjacent said subterranean zone and said packer is above said subterranean zone;

spotting a breaker fluid into an annulus formed between said tool string and said well bore above said packer;

pumping a gelled slurry down said tool string;

setting said packer;

introducing said breaker fluid from said annulus into said tool string through said mixing valve for mixing with said gelled slurry and breaking said gelled slurry into a relatively lower viscosity slurry;

pumping said lower viscosity slurry through said crossover tool into an annulus formed between said screen and said subterranean zone; and packing said subterranean zone with said low viscosity slurry.

8. The method of claim 7 wherein said gelled slurry comprises:

an aqueous solution;

a gelling agent; and particulate material.

9. The method of claim 8 wherein said aqueous solution is one of a group including fresh water, oil field brines, bay water, sea water and an aqueous salt solution.

10. The method of claim 8 wherein said gelling agent is a hydratable polymer.

11. The method of claim 10 wherein said hydratable polymer is a polysaccharide.

12. The method of claim 8 wherein said particulate material is sand.

13. The method of claim 7 wherein said breaking fluid is an aqueous acid solution.

14. The method of claim 7 wherein said lower viscosity slurry comprises:

an aqueous solution; and particulate material.

* * * * *